US011473483B2

(12) United States Patent
Fabiani

(10) Patent No.: US 11,473,483 B2
(45) Date of Patent: Oct. 18, 2022

(54) DUAL FUNCTION MANIFOLD ASSEMBLY INCORPORATING A DETACHABLE CATALYTIC CONVERTER

(71) Applicant: Fabspeed.com, Inc., Fort Washington, PA (US)

(72) Inventor: Joseph Fabiani, Fort Washington, PA (US)

(73) Assignee: Fabspeed.com, Inc., Fort Washington, PA (US)

( * ) Notice: Subject to any disclaimer, the term of this patent is extended or adjusted under 35 U.S.C. 154(b) by 82 days.

(21) Appl. No.: 17/159,530

(22) Filed: Jan. 27, 2021

(65) Prior Publication Data

US 2021/0404369 A1 Dec. 30, 2021

Related U.S. Application Data

(60) Provisional application No. 63/044,073, filed on Jun. 25, 2020.

(51) Int. Cl.

| | |
|---|---|
| ***F01N 13/18*** | (2010.01) |
| ***F01N 13/10*** | (2010.01) |
| ***F01N 13/08*** | (2010.01) |
| ***F01N 3/10*** | (2006.01) |

(52) U.S. Cl.

CPC ..... *F01N 13/1805* (2013.01); *F01N 3/10* (2013.01); *F01N 13/082* (2013.01); *F01N 13/10* (2013.01); *F01N 13/1838* (2013.01); *F01N 13/1827* (2013.01); *F01N 2410/10* (2013.01); *F01N 2450/10* (2013.01); *F01N 2450/18* (2013.01); *F01N 2450/40* (2013.01)

(58) Field of Classification Search

CPC ..... F01N 3/10; F01N 13/082; F01N 13/10; F01N 13/1805; F01N 13/1827; F01N 13/1838; F01N 2410/10; F01N 2450/10; F01N 2450/18; F01N 2450/40

USPC ..... 60/274, 299, 323

See application file for complete search history.

(56) References Cited

U.S. PATENT DOCUMENTS

| | | | | |
|---|---|---|---|---|
| 4,005,576 | A * | 2/1977 | Nohira | F01N 3/34 422/177 |
| 2007/0186546 | A1* | 8/2007 | Midgley | F01N 3/2882 60/323 |
| 2010/0139256 | A1* | 6/2010 | DeCarolis | F01N 13/18 60/299 |
| 2017/0370258 | A1* | 12/2017 | Stimmel | F16L 23/02 |

* cited by examiner

*Primary Examiner* — Jorge L Leon, Jr.
(74) *Attorney, Agent, or Firm* — Design IP

(57) ABSTRACT

A replacement kit for use with a motor vehicle that was originally equipped with an exhaust system including an exhaust manifold and a catalytic converter welded thereto. The replacement kit includes a replacement catalytic converter arranged for use during use of the motor vehicle on public roads. Rather than welding, the replacement catalytic converter attaches to the exhaust manifold using a clamp to form a gas-tight seal. The clamp is arranged to move from the closed position to an open position to enable disengagement of the replacement catalytic converter from the exhaust manifold and substitution of a bypass pipe in place of the replacement catalytic converter to increase performance characteristics of the vehicle during off-road use.

14 Claims, 10 Drawing Sheets

DUAL FUNCTION MANIFOLD ASSEMBLY INCORPORATING A DETACHABLE CATALYTIC CONVERTER

This application claims the benefit of U.S. Provisional Application No. 63/044,073, having a filing date of Jun. 25, 2020, which is incorporated by reference as if fully set forth.

BACKGROUND

The present invention relates to exhaust systems for internal combustion engines of motor vehicles. More specifically, the invention relates to a kit for replacing the originally provided catalytic converter as part of an original exhaust system to improve performance characteristics. The kit includes a replacement catalytic converter that is arranged for quick and easy attachment to the outlet end of an exhaust manifold when the motor vehicle is operating on public roads. The replacement kit also includes an openable securement clamp to enable quick and easy attachment and removal of the replacement catalytic converter to and from the outlet end of the exhaust manifold. The replacement kit also includes a bypass pipe, which may be attached to the outlet end of the exhaust manifold after removal of the replacement catalytic converter to improve the vehicle's horsepower and change other characteristics for off-road racing and all out competitions, such as driving competitions at race tracks.

The catalytic converter is responsible for the ignition and burning of engine exhaust gases which remain after an initial combustion reaction occurs. In 1975, the catalytic converter became standard equipment in the United States for all vehicles. It should be noted that driving a vehicle on public roadways without a catalytic converter is illegal. However, laws vary from state to state and some states do allow for exemptions and extensions under certain circumstances, such as for off-road racing competition and closed course use only.

A standard catalytic converter includes a catalyst that converts the gases initially exhausted from the engine into gases which are less harmful to the environment. During the combustion process, engines in vehicles release hydrocarbons, carbon monoxide, and nitrogen oxides. The catalytic converter converts the carbon monoxide into carbon dioxide. The hydrocarbons are converted into carbon dioxide and water. The nitrogen oxides are converted into oxygen and nitrogen.

On most vehicles, the catalytic converter also functions similar to a muffler. While it is operating to reduce the impact of the gases emerging from the engine, it muffles the sound of the exhaust in combination with the vehicle's muffler. If the catalytic converter is removed from the vehicle, then the sound emitted by the vehicle is louder. Driving enthusiasts who race their vehicles off of public roadways (off-road closed course race track use) may consider this effect to be a benefit. Racing competition usually involves sustained high RPMs (revolutions per minute), and extreme high temperatures. Such demands placed upon a catalytic converter during a racing competition may result in damage to the catalytic converter, or may shorten the life and emissions performance characteristics of the catalytic converter. Providing a catalytic converter that is readily removable from a vehicle's exhaust system for off-road racing competitions is beneficial since the critical emissions operation and functional durability of the catalytic converter will be spared the increased demands of race competition. Providing a catalytic converter that is readily removable also enables increased vehicle performance when removed. Providing the ability to easily reinstall to the exhaust system the catalytic converter that is un-abused and that will operate at maximum efficiency and provide maximum emissions cleanliness during road usage, e.g., commuter usage, is also a major benefit.

Also, with removal of the catalytic converter, more fuel options are available. The presence of the catalytic converter eliminates the option of using a leaded fuel and alternative fuels. When the catalytic converter is removed, several additional high-performance fuel options may be utilized for the engine that would be unavailable when the catalytic converter is in place. Driving enthusiasts who race their vehicles off of public roadways may consider this effect to be a significant performance benefit.

Performance enhancement for off-road racing is the primary reason for removing a catalytic converter. With the catalytic converter removed, the engine can pull in more fresh air and release spent exhaust gases more efficiently and make more horsepower and torque for better reliable performance. More air in the engine means the engine can burn more fuel efficiently, leading to a significant increase in power. The catalytic converter is removed, and in its place, a piece of straight exhaust pipe is attached to the exhaust manifold to create a straighter passage for the release of the spent combustion exhaust gases. Thus, the catalytic converter is spared from degradation and abuse of high RPM engine speeds.

On smaller vehicles, such as sports cars where space is at a premium, the exhaust manifold and catalytic converter are often provided from the factory as an integrated assembly, or as two component parts that are bolted or welded together in such a manner that they are intended to never be separated for removal of the catalytic converter, or separation would require substantial time and cost, and separation is likely not reversible. Typically, the inlet end of the catalytic converter is welded to the outlet end of the exhaust manifold resulting in a monolithic exhaust manifold/catalytic converter unit, which is virtually impossible to separate. Such separation may prove difficult, especially where exhaust bolts holding the two components together have been in service for many years and have rusted away.

Thus, it would be beneficial to provide a replacement kit for use in combination with an exhaust system of an internal combustion engine, the kit including a readily attachable and detachable replacement catalytic converter, an openable securement clamp, and a bypass pipe. The replacement catalytic converter is designed to replace the original catalytic converter, once the original catalytic converter has been removed from the exhaust system. The replacement catalytic converter is designed to be attached to the outlet end of an exhaust manifold for use on public roads, and is readily detachable from the exhaust manifold so that it may be replaced with a segment of straight exhaust pipe, also referred to as a bypass pipe, to enable horsepower enhancement for off-road racing and competition. The kit could be provided as an aftermarket kit, or could be installed during manufacture of the vehicle. In addition, as vehicles with engines age and/or become very high mileage, catalytic converters also age and eventually fail, and no longer scrub spent automotive gases from combustion. The replacement kit would enable a consumer to quickly and easily replace a failed catalytic converter with a new high-functioning catalytic converter, which is a benefit to the environment.

Alternatively, it would be beneficial to provide a kit to replace certain components of an existing original equipment manufacturer (OEM) exhaust system to enable enhanced horsepower. The kit includes a higher performance catalytic converter arranged for replacing the original catalytic converter provided as part of the OEM exhaust system. Under this second embodiment, at its inlet end, the higher performance catalytic converter is arranged for attachment to the existing exhaust manifold, by conventional means, such as bolting. The kit also includes an openable securement clamp to enable attachment of the outlet end of the higher performance durable catalytic converter to the exhaust pipe of the OEM exhaust system. The kit also includes a length of straight pipe, or a bypass pipe, arranged for replacing the high-performance catalytic converter. At its inlet end, the length of straight pipe is arranged for attachment to the existing exhaust manifold by conventional means, such as bolting. The kit also provides an openable securement clamp which is arranged to enable attachment of the outlet end of the bypass pipe to the remaining components of the OEM exhaust system to enhance horsepower, and provide a louder sports car sound from the vehicle.

SUMMARY

In one aspect of the invention, there is provided a replacement kit for use with a motor vehicle that was originally equipped with an exhaust system including an exhaust manifold and a catalytic converter welded thereto. The replacement kit includes a replacement catalytic converter arranged for use during use of the motor vehicle on public roads. Rather than welding, the replacement catalytic converter attaches to the exhaust manifold using a clamp to form a gas-tight seal. The clamp is arranged to move from the closed position to an open position to enable disengagement and removal of the replacement catalytic converter from the exhaust manifold and substitution of a bypass pipe in place of the replacement catalytic converter to increase performance characteristics of the vehicle during off-road use such as racing competitions.

BRIEF DESCRIPTION OF THE DRAWINGS

The invention will be described in conjunction with the following drawings in which like reference numerals designate like elements and wherein.

DETAILED DESCRIPTION OF THE PREFERRED EMBODIMENT

Figure 1:
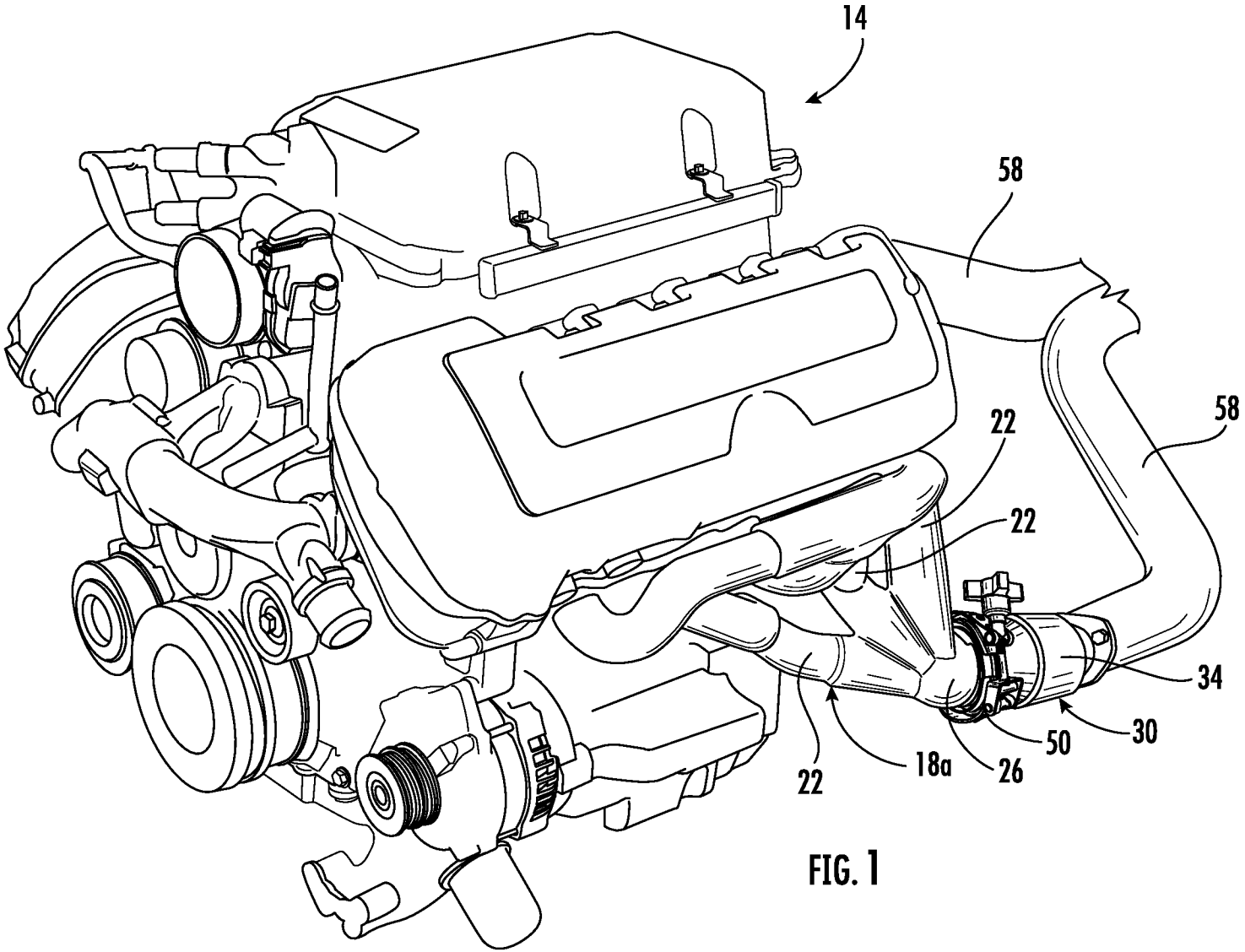
FIG. 1 is a perspective view of left and right replacement catalytic converters of a first embodiment kit of the present invention attached to left and right exhaust manifolds of an internal combustion engine utilizing openable securement clamps also provided by the first embodiment kit.
Figure 2:
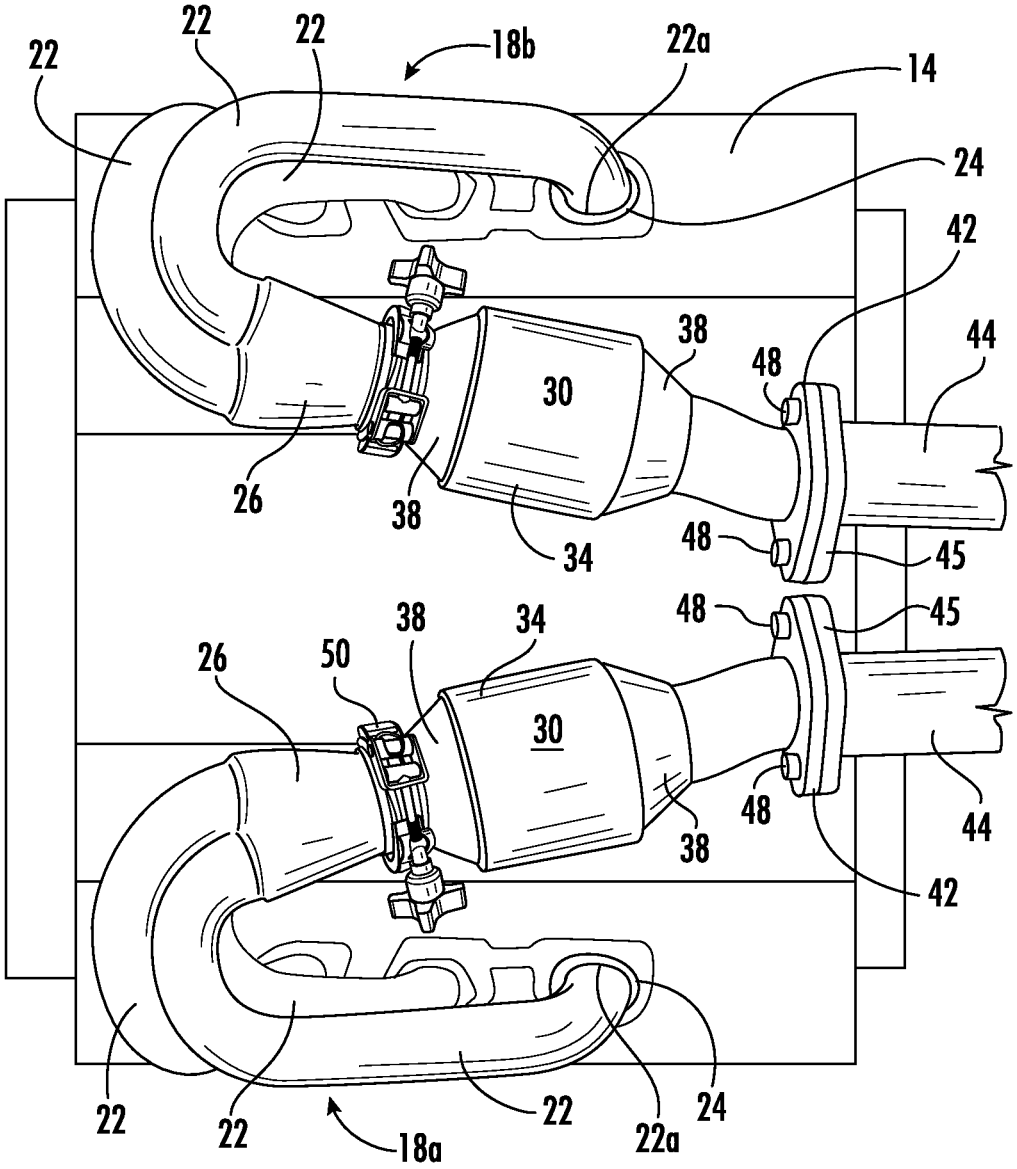
FIG. 2 is an enlarged bottom view illustrating left and right replacement catalytic converters of the first embodiment kit of the present invention secured to the outlet ends of the exhaust manifolds of an internal combustion engine utilizing kit-provided openable securement straps.
Figure 3:
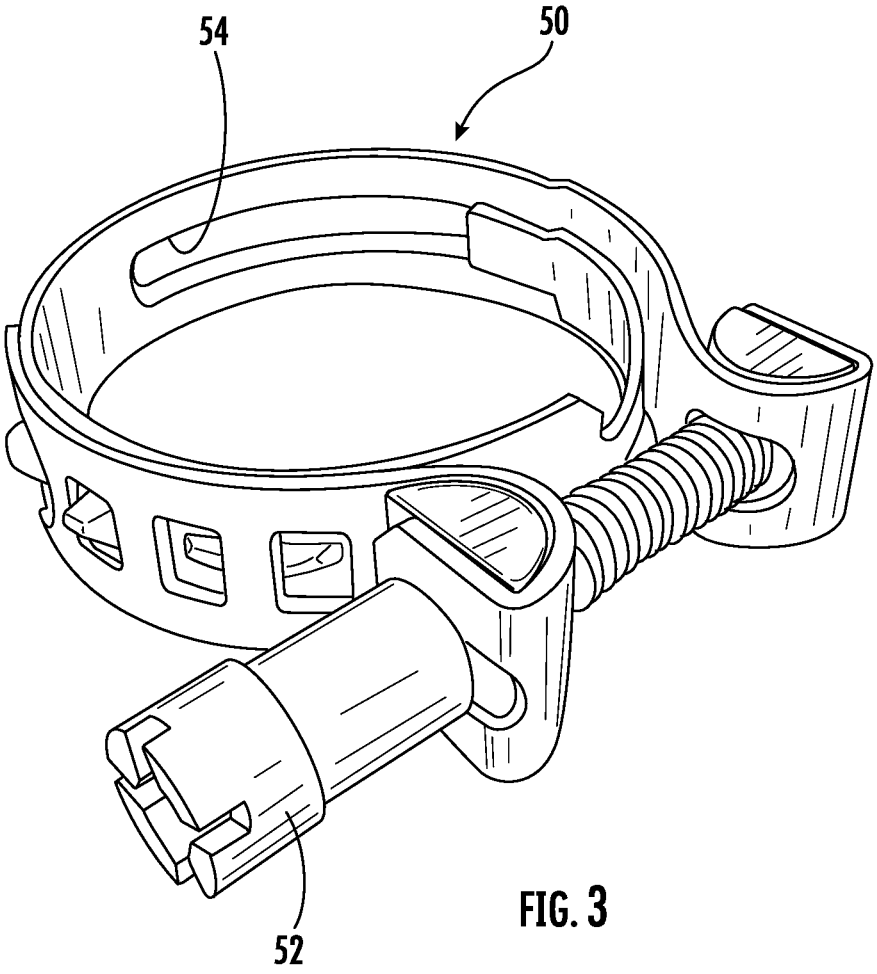
FIG. 3 is an enlarged perspective view of an openable securement clamp of the first embodiment kit of the present invention.
Figure 4:
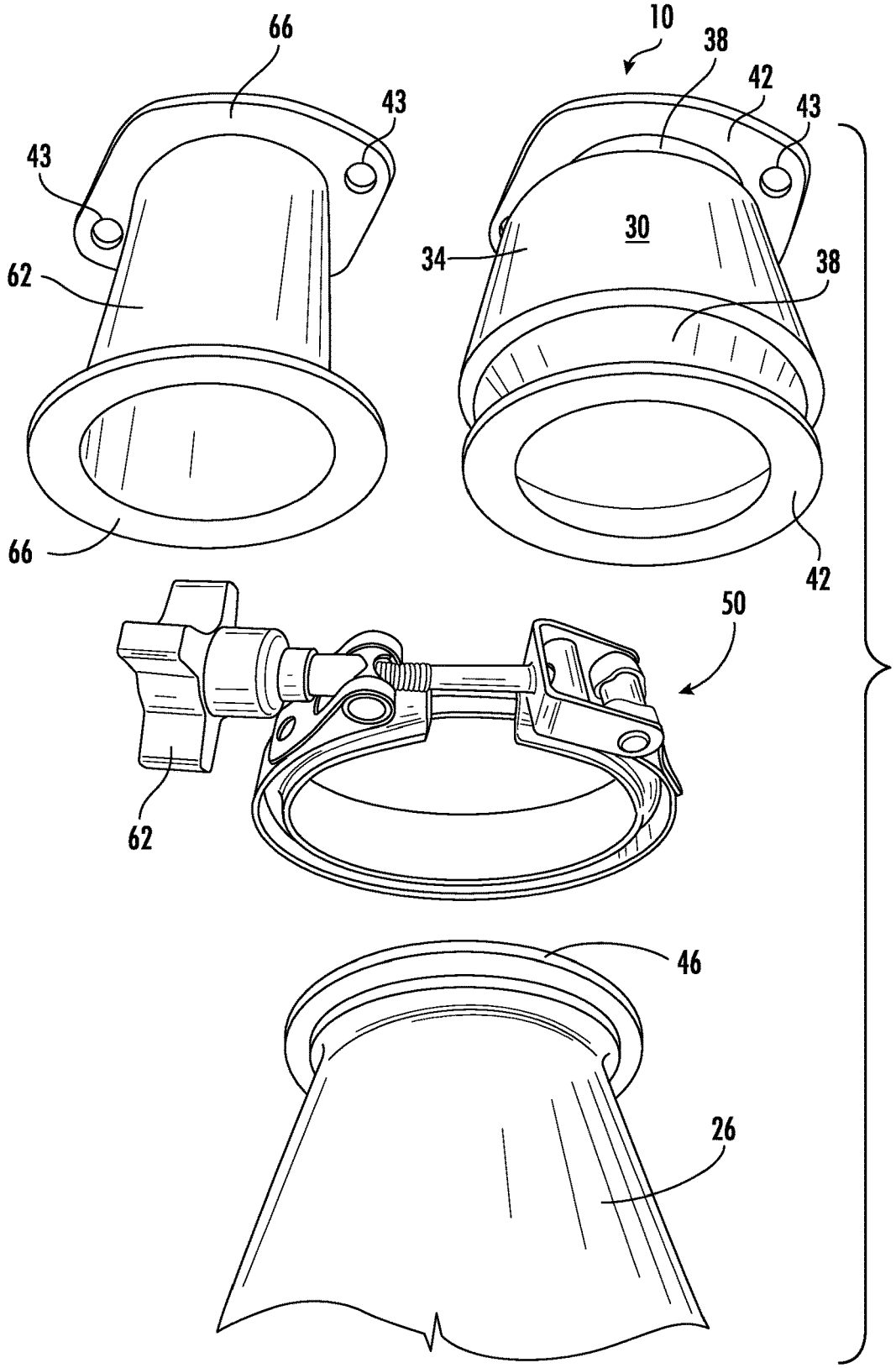
FIG. 4 is an enlarged perspective view of a replacement catalytic converter, a bypass pipe, and an openable securement strap provided by the first embodiment kit shown positioned adjacent to a common collector of an original exhaust manifold.

Referring now to FIGS. 1 through 6, there is shown a first embodiment kit 10 (FIG. 4) for replacing the originally provided catalytic converter (not shown) on an internal combustion engine 14 of a motor vehicle. As best shown in FIG. 4, the kit 10 includes three components including a replacement catalytic converter 30, a bypass pipe 62, and an openable securement strap 50. The parts are arranged to replace an original catalytic converter (not shown) and are to be affixed between the outlet end of a common collector 26 of an exhaust manifold 18*a*, 18*b* and the inlet end of an exhaust pipe, as will be described below. As best shown in FIGS. 1 and 2, the internal combustion engine 14 includes an exhaust manifold assembly including a left manifold 18*a* and a right manifold 18*b*. Each manifold 18*a*, 18*b* includes a plurality of branching pipes 22 adapted to be placed in gaseous fluid communication with the individual cylinders of the combustion engine 14 with which the manifold assembly is intended to be used. The branching pipes 22 may be formed in any suitable size and configuration as dictated by the space limitations of the motor vehicle and the requirements of the combustion engine. In practice, the exhaust manifold is conventionally made from ferrous steel and/or stainless steel, but for purposes of this invention, may be made from any material from which exhaust manifolds are conventionally manufactured.

As best shown in FIG. 2, each branching pipe 22 includes an inlet end 22*a* (FIG. 2) that is connectible to an exhaust port 24 of a cylinder of the internal combustion engine 14. In FIG. 2, the manifold assembly is illustrated as including a left manifold 18*a* and a right manifold 18*b*. The left manifold 18*a* is arranged for attachment to a left cylinder head of the combustion engine 14, while the right manifold 18*b* is arranged for attachment to a right cylinder head of the combustion engine 14. As illustrated in FIGS. 1 and 2, each manifold 18*a*, 18*b* is shown as comprising three branching pipes 22 making the left and right manifolds 18*a*, 18*b* suited for attachment to a six-cylinder combustion engine 14. However, it should be understood that each manifold 18*a*, 18*b* may include two branching pipes 22 suited for attachment to a four-cylinder combustion engine 14, or may include four branching pipes 22 suited for attachment to an eight-cylinder combustion engine 14, or may include any number of branching pipes 22, greater or fewer depending upon the number of cylinders in the combustion engine 14. The branching pipes 22 extend from the inlet end 22*a* and converge into a common collector 26.

As mentioned previously, on smaller vehicles, such as sports cars where space is at a premium, the exhaust manifold and the original catalytic converter (not shown) is often provided from the factory as an integrated assembly, or as two component parts that are permanently bolted or welded together in such a manner that they are never intended to be separated for removal of the catalytic converter, or separation would require substantial time and cost, and separation is likely not reversible. Typically, the original catalytic converter is welded to the exhaust manifold in a monolithic one-piece unit. Prior to utilizing the first embodiment kit 10, the original catalytic converter is detached from its weldment to the exhaust manifold, such as by using a chisel, saw, cutting torch, and hammer.

Figure 5:
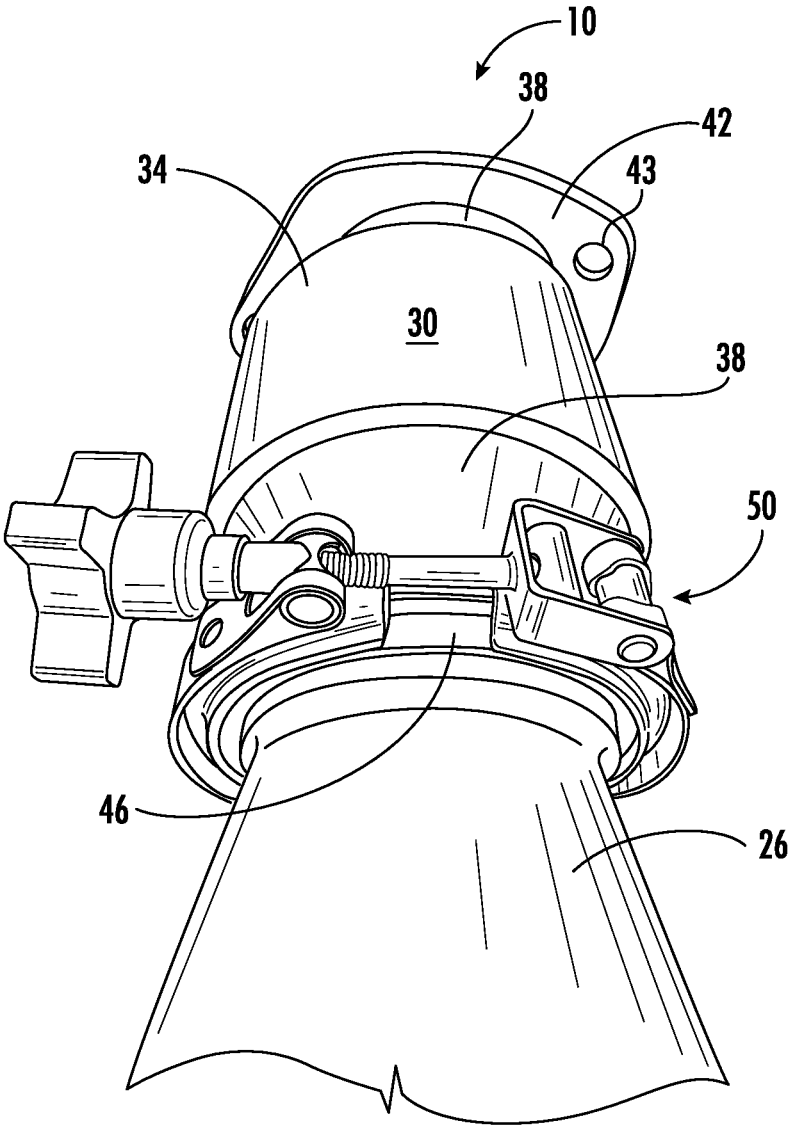
FIG. 5 is an enlarged perspective view of a replacement catalytic converter of the first embodiment kit of the present invention affixed to the outlet end of an exhaust manifold of an internal combustion engine utilizing the kit-provided openable securement clamp.
Figure 6:
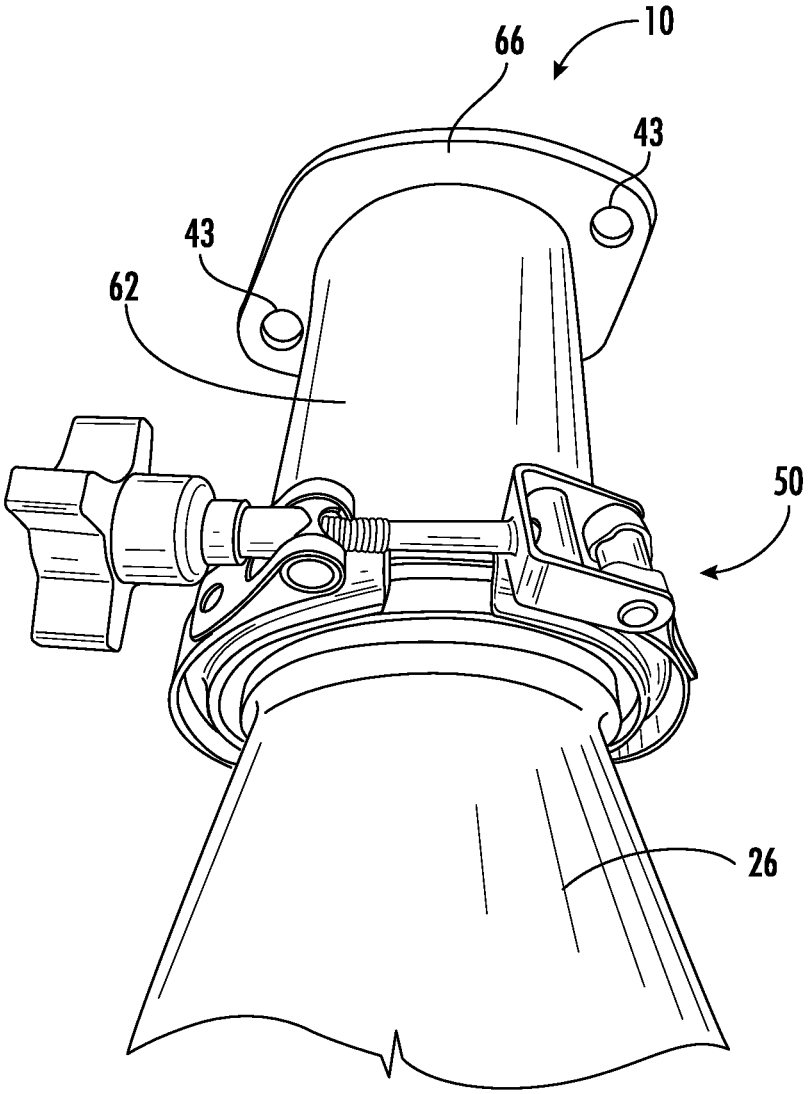
FIG. 6 is an enlarged view of the catalytic converter bypass pipe of the first embodiment kit of the present invention affixed to the outlet end of the exhaust manifold utilizing the kit-provided openable securement clamp.

As best shown in FIGS. 4 through 6, the first embodiment kit 10 of the present invention includes a replacement catalytic converter 30, a bypass pipe 62, and a securement clamp 50 for each exhaust manifold 18*a* and 18*b*. The replacement catalytic converters 30 are arranged to be readily attached to the exhaust manifolds 18*a* and 18*b* when it is desired to drive on public roads where catalytic converters are required by law. In particular, as best shown in FIGS. 2 and 4, each replacement catalytic converter 30 includes a generally cylindrical central portion 34 and truncated end cones 38 attached at opposite ends of the central portion 34 to provide the catalytic converter with a gas-tight seal. Referring now to FIGS. 4 and 5, each of the end cones 38 of the replacement catalytic converter 30 may be provided with a circumferential upstanding flange 42 located at a free end thereof. As best shown in FIGS. 4 and 5, the circumferential upstanding flange 42 may be sized to match and may be arranged to be brought into abutting relation with a corresponding circumferential upstanding flange 46 located at the outlet end of the common collector 26. One or both upstanding flanges 46 may include through openings to enable securement to a corresponding upstanding flange utilizing conventional hardware, e.g., nuts and bolts. Once the matching upstanding flanges 42 and 46 are brought into abutting relation, the openable securement clamp 50 may be opened and placed to surround the upstanding flanges 42 and 46 and then moved to the closed or clamping position to bring together the replacement catalytic converter 30 and the common collector 26 to create a gas tight seal therebetween. As best shown in FIG. 2, at its outlet end, the replacement catalytic converter 30 is arranged for connection to other elements of the exhaust system, e.g., the exhaust pipe 44 by any suitable means, e.g., bolts 48 extending through matching flanges 42 and 45 located at the outlet end of the replacement catalytic converter 30 and the inlet end of the exhaust pipe 44, respectively.

Although one particular type of clamp is illustrated in FIGS. 1-6, it should be understood that any suitable openable clamp may be utilized to secure the replacement catalytic converter 30 to the common collector 26 to create a gas tight seal therebetween. For example, as best shown in FIG. 3, the openable clamp 50 could be a stepless screw clamp having a tightening screw 52 and an offset groove 54 designed to accept the abutting flanges 42, 46 therein. Of course, other fastener elements could be used for the same purpose of connecting the replacement catalytic converter 30 to the common collector 26 to create a gas tight seal therebetween. For example, a threaded ring could be used in lieu of an openable clamp, or a snap-in-style retainer ring or any other conventional style of quick-release fastener element could be utilized to secure the replacement catalytic converter 30 to the common collector 26.

With the replacement catalytic converter 30 in place, exhaust gas flows from the exhaust ports of the combustion engine 14 and pass through the branch pipes 22 of the exhaust manifolds 18*a* and 18*b* and then enter the replacement catalytic converter 30. The harmful components of the exhaust gases are either oxidized or reduced by the replacement catalytic converter 30 thereby to cleanse the engine exhaust gases. The cleansed gas flows into an exhaust pipe attached at the outlet end of the replacement catalytic converter 30. During operation of the motor vehicle on public roads, with the replacement catalytic converter 30 in place, the impact of gases emerging from the engine is reduced.

As will be apparent, when it is desired to obtain additional horsepower such as when using the motor vehicle for off-road racing such as at race tracks, the openable securement clamp 50 may be moved from the clamping position to the open position to enable easy detachment of the replacement catalytic converter 30 from the common collector 26. In place of the replacement catalytic converter 30, a bypass pipe 62 (FIGS. 4 and 6) may be attached to the common collector 26. Similar to the replacement catalytic converter 30, at its inlet end, the bypass pipe 62 may be provided with a circumferential upstanding flange 66 matching the dimensions of the upstanding flange 46 located at the outlet end of the common collector 26. One or both upstanding flanges 66 of the bypass pipe 62 may include through openings to enable optional securement to a corresponding flange on an adjacent element of the exhaust system utilizing conventional hardware, e.g., nuts and bolts. Once the matching upstanding flanges 66 and 46 are brought into abutting relation, the openable securement clamp 50 may be opened and placed to surround the abutting upstanding flanges 66 and 46 of the bypass pipe 62 and the common collector 26, respectively, and then moved to the clamping position to bring together the bypass pipe 62 and the common collector 26 to create a gas tight seal therebetween. At its outlet end, the bypass pipe 62 is arranged for connection to other elements of the exhaust system, e.g., the exhaust pipe, by any suitable means, e.g., bolting together corresponding flanges, as discussed above. With the catalytic converter 30 removed, its constrictive effects on exhaust gases exiting the engine are removed, allowing exhaust gases to exist the engine much faster and at higher levels resulting in an increase in horsepower.

Figure 7:
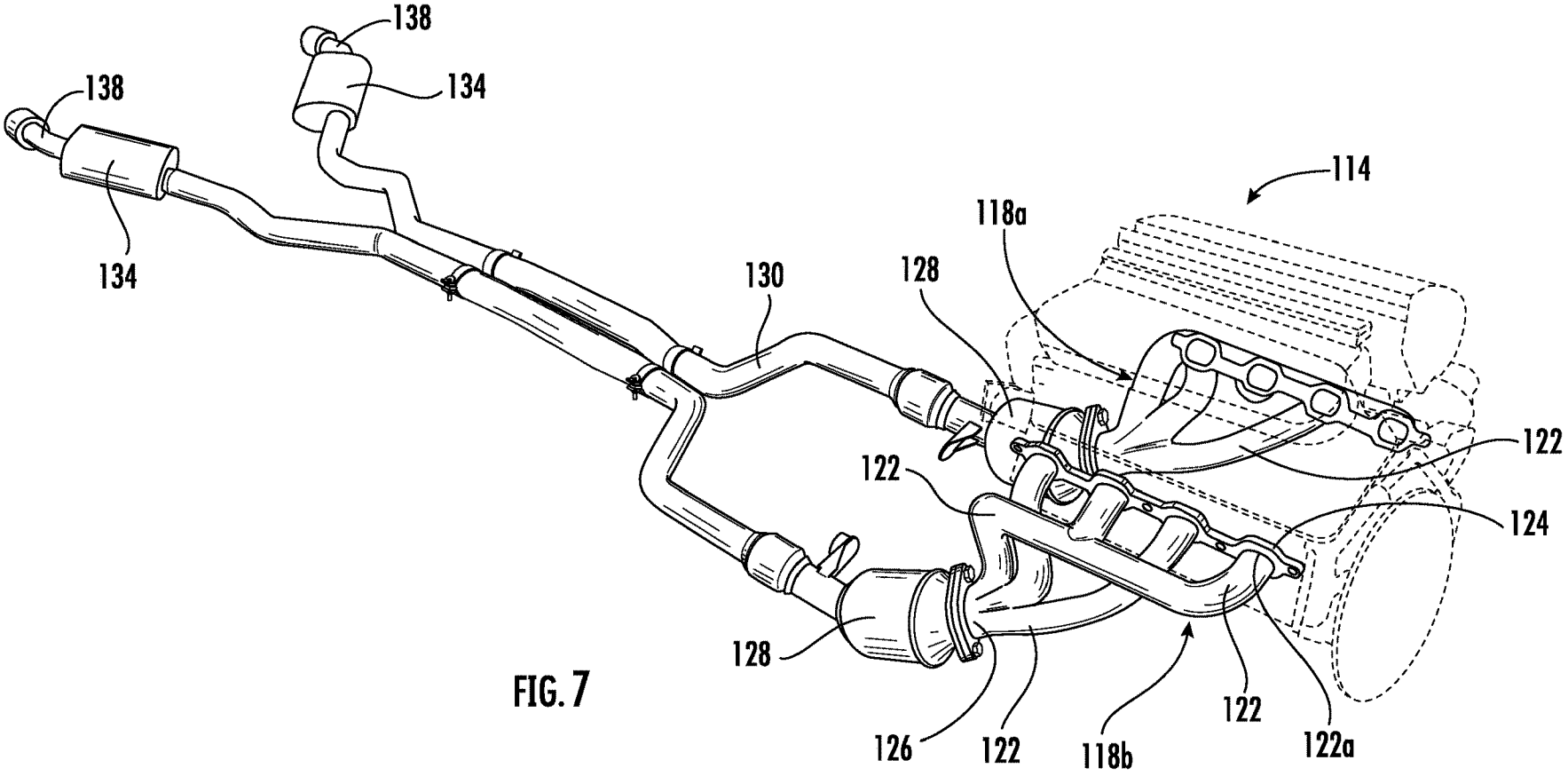
FIG. 7 is a perspective view of an original exhaust system of an internal combustion engine.
Figure 8:
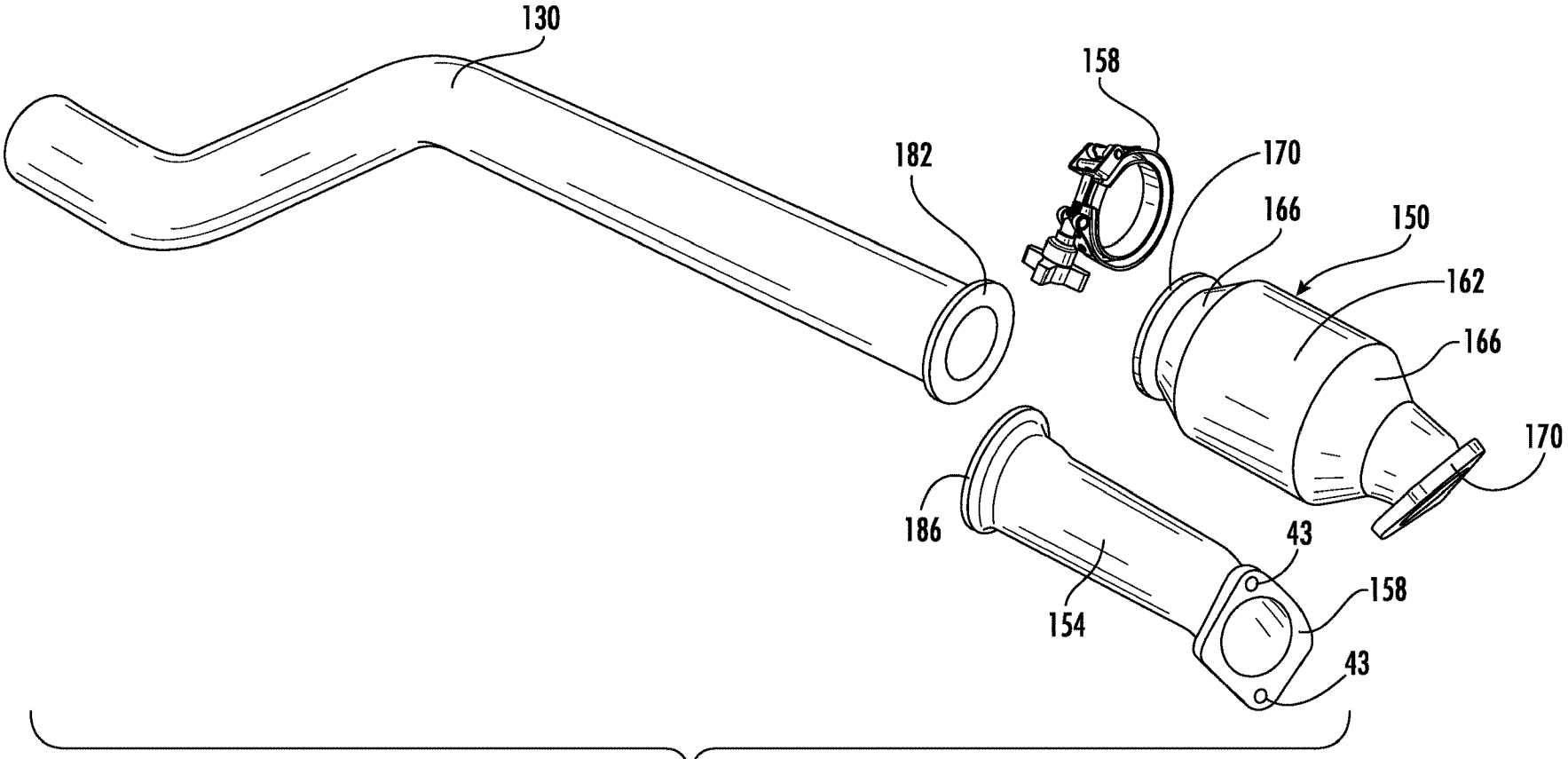
FIG. 8 is a perspective view illustrating a replacement catalytic converter, a securement clamp, a catalytic converter bypass pipe, and a length of exhaust pipe forming components of a second embodiment kit of the present invention positioned adjacent a length of exhaust pipe.

Referring now to FIGS. 7-10, there is shown a second embodiment kit 100 for replacing the originally provided catalytic converter (not shown) on an internal combustion engine 114 of a motor vehicle. As best shown in FIG. 8, the second embodiment kit 100 includes a replacement high-performance catalytic converter 150, a bypass pipe 154, and an openable securement clamp 158 for each exhaust manifold 118*a* and 118*b*.

Referring now to FIG. 7, there is shown a standard combustion engine 114 including its original exhaust system comprising an exhaust manifold assembly including a left manifold 118*a* and a right manifold 118*b*. Under this arrangement, rather than the inlet end of the original catalytic converter being permanently welded to the outlet end of the exhaust manifold, it is often conventional for these two components to be held together by a less-permanent means, such as by bolting. However, under this conventional arrangement, the outlet end of the catalytic converter is often joined to other elements of the exhaust system by more permanent means, such as by welding. The second embodiment kit is arranged to be utilized on this conventional arrangement.

Each manifold 118*a*, 118*b* includes a plurality of branching pipes 122 adapted to be placed in gaseous fluid communication with the individual cylinders of the combustion engine 114 with which the manifold assembly is intended to be used. The branching pipes 122 may be formed in any suitable size and configuration as dictated by the space limitations of the motor vehicle and the requirements of the combustion engine. Each branching pipe 122 includes an inlet end 122*a* (FIG. 7) that is connectible to an exhaust port 124 of a cylinder of the internal combustion engine 114. The left manifold 118*a* is arranged for attachment to a left cylinder head of the combustion engine 114, while the right manifold 118*b* is arranged for attachment to a right cylinder head of the combustion engine 114. Each manifold 118*a*, 118*b* is shown as comprising four branching pipes 122 making the left and right manifolds 118*a*, 118*b* suited for attachment to an eight-cylinder combustion engine 114. However, it should be understood that this second embodiment, like the first embodiment, may be utilized with internal combustion engines having a greater or fewer number of cylinders. The branching pipes 122 extend from the inlet end 122*a* and converge into a common collector 126.

As shown in FIG. 7, at the outlet end of the common collector 126, the original catalytic converter 128 is attached. As mentioned above, the manner for conventional attachment is by any suitable means, such as by bolting. However, at its outlet end, the original catalytic converter 128 is permanently attached, such as by welding, to other components of the exhaust assembly, such as an exhaust pipe 130, which extends to a muffler 134, which extends to a tail pipe 138.

Prior to utilizing the second embodiment replacement kit, the inlet end of the original catalytic converter 128 may be disconnected, e.g., unbolted, from the outlet end of the exhaust manifold 118*a*, 118*b*, and the outlet end of the original catalytic converter 128 may be disconnected from the exhaust pipe 130, such as by detaching it from its weldment to the exhaust pipe 130, such as by utilizing a chisel, a hammer, and a saw.

Figure 9:
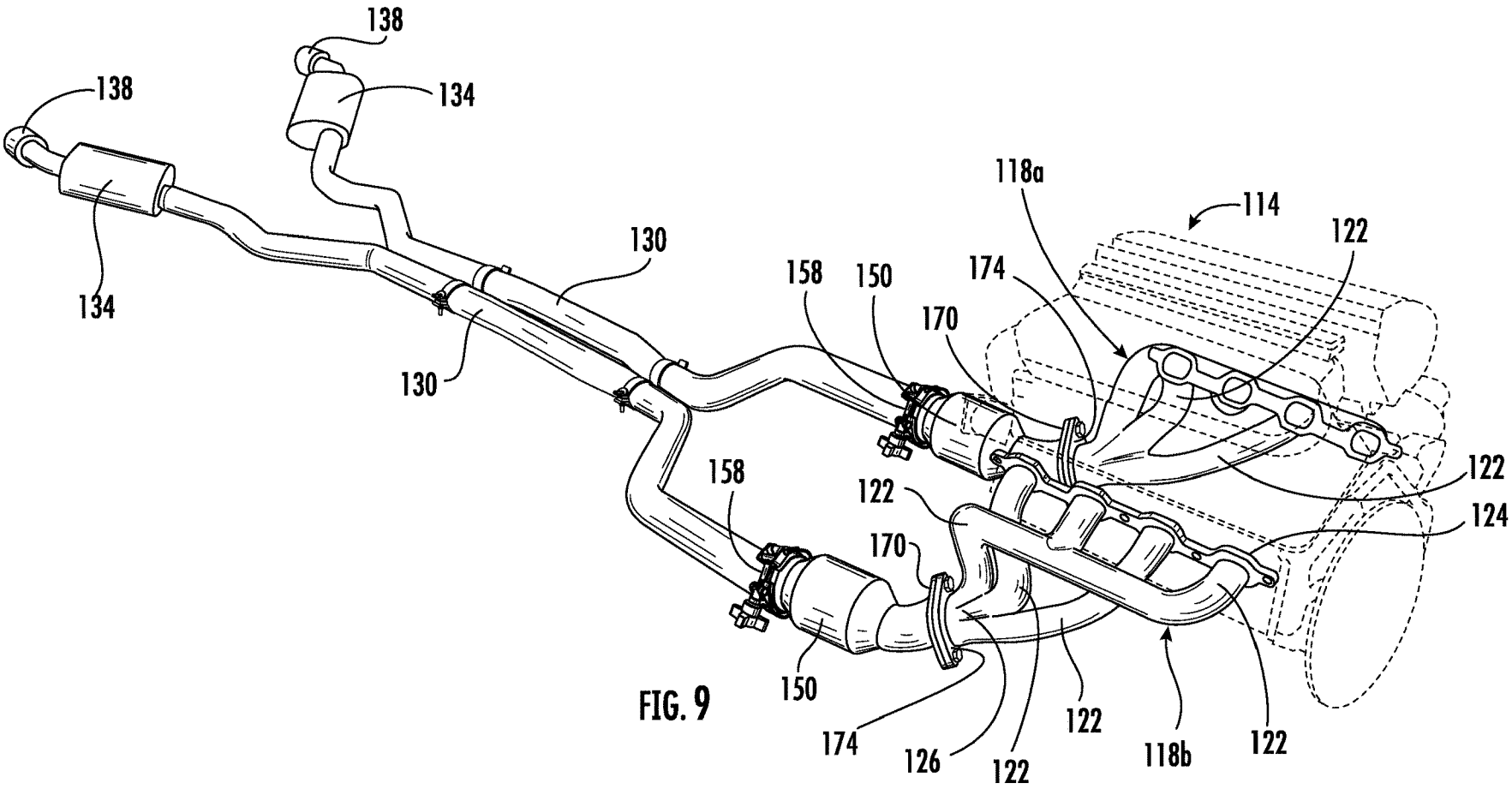
FIG. 9 is a perspective view illustrating components of the second embodiment kit of the present invention including a replacement catalytic converter installed on an internal combustion engine utilizing the kit-provided openable securement clamp; and, FIG. 10 is a perspective view illustrating components of the second embodiment kit of the present invention including a bypass pipe installed on an internal combustion engine utilizing the kit-provided openable securement clamp.

As best shown in FIG. 8, the second embodiment kit of the present invention includes a replacement catalytic converter 150, a bypass pipe 154, and an openable securement clamp 158 for each exhaust manifold 118*a* and 118*b*. The replacement catalytic converter 150 may be a higher performance catalytic converter that enables better vehicle performance characteristics than the original catalytic converter 128. The replacement catalytic converter 150 is arranged to be readily attached to the exhaust manifolds 118*a* and 118*b* when it is desired to drive on public roads where catalytic converters are required by law. In particular, as best shown in FIG. 8, each replacement catalytic converter 150 includes a generally cylindrical central portion 162 and truncated end cones 166 attached at opposite ends of the central portion 162 to provide the catalytic converter with a gas-tight seal. The end cones 166 of the replacement catalytic converter 150 may be provided with a circumferential upstanding flange 170 located at the opposed free ends of each truncated end cone 166. The circumferential upstanding flanges 170 may be sized to match and may be arranged to be brought into abutting relation with a corresponding circumferential upstanding flange 174 located at the outlet end of the common collector 126 (FIG. 9). As best shown in FIG. 9, once the matching upstanding flanges 170 and 174 are brought into abutting relation, the replacement catalytic converter 150 may be attached to the exhaust manifold, 118*a* and 118*b*, by any suitable means, e.g., bolting.

Referring now to FIGS. 8 and 9, at its outlet end, the circumferential upstanding flange 170 of the replacement catalytic converter 150 may be sized to match and arranged to be brought into abutting relation with a corresponding circumferential upstanding flange 182 located at the inlet end of the exhaust pipe 130. Once the matching upstanding flanges 170 and 182 are brought into abutting relation, the openable securement clamp 158 may be opened and placed to surround the upstanding flanges 170 and 182 and then moved to the closed or clamping position to bring together the replacement catalytic converter 150 and the exhaust pipe 130 to create a gas tight seal therebetween.

As state above, although only one particular type of openable securement clamp 158 is illustrated in FIGS. 7-10, it should be understood that any suitable openable securement clamp may be utilized to secure the catalytic converter 150 to the exhaust pipe 130.

With the replacement catalytic converter 150 in place, exhaust gas flows from the exhaust ports of the combustion engine 114 and pass through the branch pipes 122 of the exhaust manifolds 118*a* and 118*b* and then enter the replacement catalytic converter 150. The harmful components of the exhaust gases are either oxidized or reduced by the replacement catalytic converter 150 thereby to cleanse the engine exhaust gases. As best shown in FIG. 9, the cleansed gas flows into an exhaust pipe 130 attached at the outlet end of the catalytic converter 150, and exit through the muffler 134, and tail pipe 138. During operation of the motor vehicle on public roads, with the replacement catalytic converter 150 in place, the impact of gases emerging from the engine is reduced, and, to a degree, greater performance characteristics may be obtained.

Figure 10:
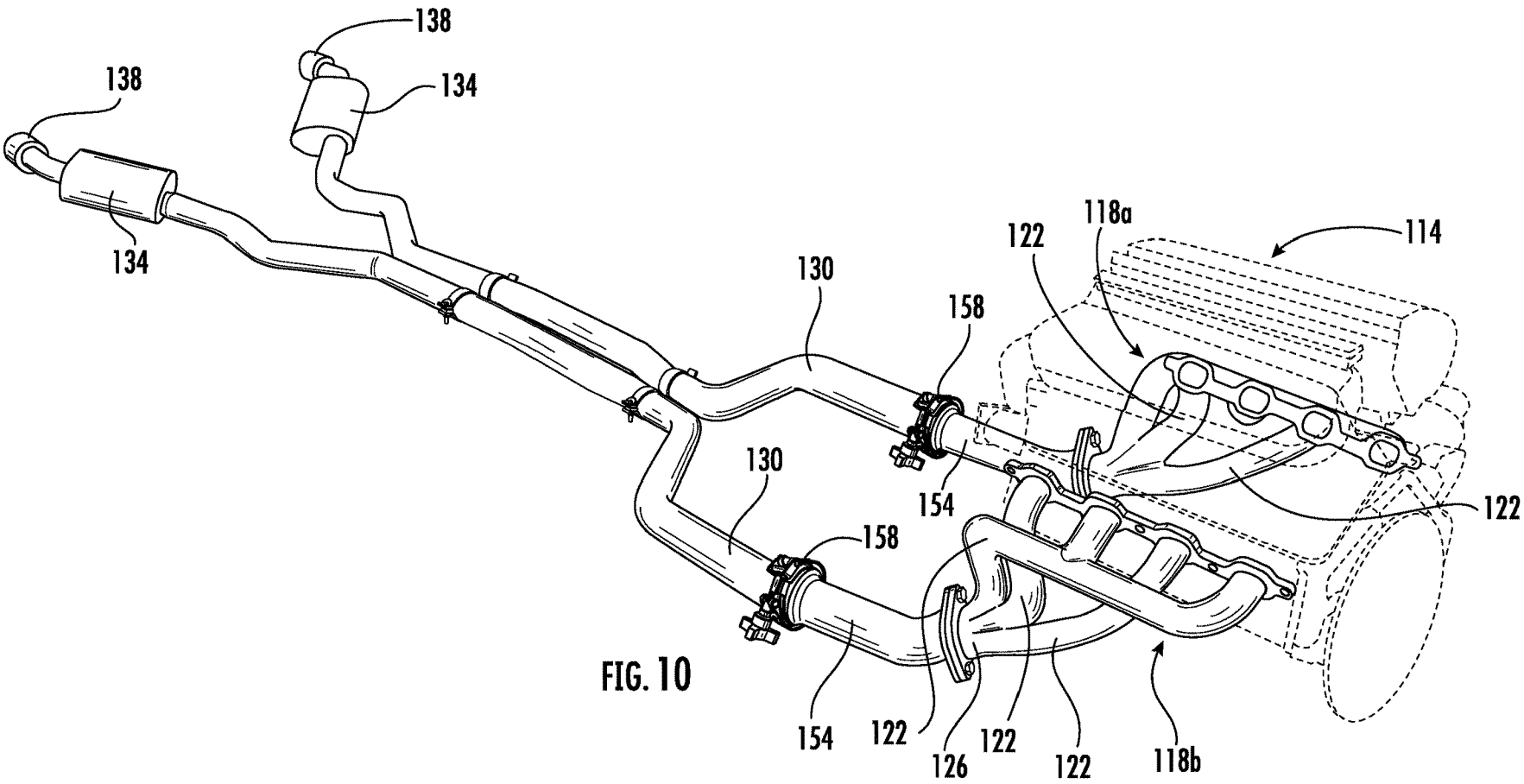

Referring now to FIGS. 8-10, as will be apparent, when it is desired to obtain additional horsepower such as when using the motor vehicle for off-road racing such as at race tracks, the openable securement clamp 158 may be moved from the clamping position to the open position to enable easy detachment of the replacement catalytic converter 150 from the exhaust pipe 130. At its inlet end, the replacement catalytic converter 150 may be unbolted from the common collector 126. In place of the replacement catalytic converter 150, the bypass pipe 154 may be attached to the common collector 126 by any suitable means, e.g., bolting. Similar to the catalytic converter 150, at its inlet end, the bypass pipe 154 may be provided with a circumferential upstanding flange 158 matching the dimensions of the upstanding flange 174 located at the outlet end of the common collector 126. Once the matching upstanding flanges are brought into abutting relation, the outlet end of the common collector 126 may be attached to the inlet end of the bypass pipe 154 by any suitable means, e.g., bolting. At its outlet end, the bypass pipe 154 includes an upstanding flange 186 (FIG. 8) matching the dimensions of the upstanding flange 182 located at the inlet end of the exhaust pipe 130. The openable securement clamp 158 may be opened and placed to surround the abutting upstanding flanges 186 and 182 of the bypass pipe 154 and the exhaust pipe 130, respectively, and then moved to the clamping position to bring together the bypass pipe 154 and the exhaust pipe 130 to create a gas tight seal therebetween.

With the replacement catalytic converter 150 removed, its constrictive effects on exhaust gases exiting the engine are removed, allowing exhaust gases to exist the engine much faster and at higher levels resulting in an increase in horsepower.

While a specific embodiment of the invention has been shown and described in detail to illustrate the application of the inventive principles, it will be understood that the invention may be embodied otherwise without departing from such principles.

What is claimed is:

1. A replacement kit suitable for use with a motor vehicle that was originally equipped with an exhaust system including an exhaust manifold having a plurality of branch pipes converging into a common outlet end, and an original catalytic converter having an upstream end fixed to the outlet end of the exhaust manifold, and a downstream end for connecting to a remaining portion of the exhaust system, the original catalytic converter having been detached from the exhaust system for replacement, the replacement kit comprising:

a. a replacement catalytic converter arranged to replace the original catalytic converter, the replacement catalytic converter including a first end configured to connect to the outlet end, and a second end configured to connect to the remaining portion of the exhaust system, b. a bypass pipe arranged to interchangeably replace the replacement catalytic converter, the bypass pipe including a first pipe end configured to connect to the outlet end, and a second pipe end configured to connect to the remaining portion of the exhaust system, and c. a clamp arranged to surround the outlet end and one of the first end or the first pipe end so as to selectively connect the exhaust manifold to the replacement catalytic converter or to the bypass pipe, respectively, via a gas-tight seal, wherein the clamp is further arranged to loosen so as to release the one of the first end or the first pipe end, thereby disconnecting the replacement catalytic converter or the bypass pipe from the exhaust manifold, and receive a remaining one of the first end or the first pipe end.

2. The replacement kit of claim 1, wherein the original catalytic converter is fixed to the exhaust manifold via welding.

3. The replacement kit of claim 1, wherein the remaining portion of the exhaust system includes an exhaust pipe, a muffler, and a tailpipe.

4. The replacement kit of claim 1, wherein the clamp is an aircraft type clamp.

5. The replacement kit of claim 1, wherein the exhaust manifold is constructed of cast iron.

6. The replacement kit of claim 1, wherein the plurality of branch pipes comprises three exhaust tubes.

7. The replacement kit of claim 1, wherein each branch pipe has a tubular configuration.

8. The replacement kit of claim 1, wherein the replacement catalytic converter includes an intermediate cylindrical portion between the first end and the second end.

9. A replacement kit suitable for use with a motor vehicle that was originally equipped with an exhaust system including an original catalytic converter having an upstream end arranged for connecting to an outlet end of an exhaust manifold, and a downstream end fixed to a remaining portion of the exhaust system, the original catalytic converter having been detached from the exhaust system for replacement, the replacement kit comprising:

a. a catalytic converter arranged to replace the original catalytic converter, the catalytic converter including a first end configured to connect to the outlet end, and a second end configured to connect to the remaining portion of the exhaust system, b. a bypass pipe arranged to interchangeably replace the catalytic converter, the bypass pipe including a first pipe end configured to connect to the outlet end, and a second pipe end configured to connect to the remaining portion of the exhaust system, and c. a clamp arranged to surround one of the second end or the second pipe end so as to selectively connect the catalytic converter or the bypass pipe, respectively, to the remaining portion of the exhaust system via a gas tight seal, wherein the clamp is further arranged to loosen so as to release the one of the second end or the second pipe end, thereby disconnecting the catalytic converter or the bypass pipe from the remaining portion of the exhaust system, and receive a remaining one of the second end or the second pipe end.

10. The replacement kit of claim 9, wherein the downstream end of the original catalytic converter is fixed to the remaining portion of the exhaust system via welding.

11. The replacement kit of claim 9, wherein the remaining portion of the exhaust system includes an exhaust pipe.

12. The replacement kit of claim 11, wherein the remaining portion of the exhaust system further includes a muffler connected downstream of the exhaust pipe, and a tail pipe connected downstream of the muffler.

13. The replacement kit of claim 9, wherein the catalytic converter is a high-performance catalytic converter in comparison to the original catalytic converter.

14. A method for modifying an original equipment manufacturer (OEM) exhaust system of a motor vehicle, the OEM exhaust system including an original catalytic converter having an upstream end attached to an outlet end of an exhaust manifold, and a downstream end welded to an inlet end of an exhaust extension pipe, the method comprising:

a. detaching the original catalytic converter from the exhaust manifold and the exhaust extension pipe;

b. providing a replacement catalytic converter arranged to replace the original catalytic converter, the replacement catalytic converter including a first end configured to connect to the exhaust manifold, and a second end configured to connect to the exhaust extension pipe;

c. providing a bypass pipe arranged to interchangeably replace the replacement catalytic converter, the bypass pipe including a first pipe end configured to connect to the exhaust manifold, and a second pipe end configured to connect to the exhaust extension pipe; and d. providing a clamp arranged to be alternately moved between an open position and a closed position;

e. moving the clamp from the open position to the closed position so as to couple one of the second end or the second pipe end to the inlet end via a gas tight seal;

f. moving the clamp from the closed position to the open position so as to decouple the one of the second end or the second pipe end from the inlet end, thereby detaching the replacement catalytic converter or the bypass pipe, respectively, from the exhaust extension pipe; and, g. moving the clamp from the open position to the closed position so as to couple a remaining one of the second end or the second pipe end to the inlet end via a gas tight seal.

* * * * *